US005664281A

United States Patent [19]

Pelfrey

[11] Patent Number: 5,664,281

[45] Date of Patent: Sep. 9, 1997

[54] SUNTAN LOTION APPLICATOR

[76] Inventor: Diana L. Pelfrey, P.O. Box 1115, Kamuela, Hi. 96743

[21] Appl. No.: 607,835

[22] Filed: Feb. 27, 1996

[51] Int. Cl.[6] ..... A47K 7/02

[52] U.S. Cl. ..... 15/244.2; 15/144.1; 15/144.3; 15/144.4; 15/210.1; 15/222; 15/244.1; 206/229; 206/497; D28/7

[58] Field of Search ..... 15/104.94, 144.1–144.4, 15/209.1, 210.1, 222, 244.1, 244.2; 206/229, 497, 581; 401/6, 8; D28/7, 63

[56] References Cited

U.S. PATENT DOCUMENTS

| | | | |
|---|---|---|---|
| 1,973,768 | 9/1934 | Knapp | 15/244.1 X |
| 2,936,475 | 5/1960 | Johns | 15/144.4 X |
| 3,103,682 | 9/1963 | Markle | 15/244.1 |
| 3,463,302 | 8/1969 | Preston | 15/104.94 X |
| 3,936,198 | 2/1976 | Martin | 15/222 X |
| 3,959,841 | 6/1976 | Horne | 15/222 X |
| 4,299,005 | 11/1981 | Brown | 15/244.2 |
| 4,381,766 | 5/1983 | Avolio | 15/210.1 X |
| 4,396,028 | 8/1983 | Waggoner | 15/144.4 |
| 4,483,356 | 11/1984 | Kales | 15/210.1 X |
| 4,941,226 | 7/1990 | Kemper | 15/104.94 X |
| 5,035,523 | 7/1991 | Allinder | 15/222 X |
| 5,360,111 | 11/1994 | Arispe | 401/6 X |
| 5,566,418 | 10/1996 | Steffen et al. | 15/244.1 |

FOREIGN PATENT DOCUMENTS

| | | | |
|---|---|---|---|
| 1047837 | 11/1966 | United Kingdom | 15/222 |

*Primary Examiner*—Mark Spisich
*Attorney, Agent, or Firm*—Michael I. Kroll

[57] ABSTRACT

A suntan lotion applicator (10) which comprises a structure (12) for holding a specific amount of suntan lotion (14) poured out from a suntan lotion bottle (16). A component (18) for grasping, by the hands (20) of a person (22), extends from the suntan lotion holding structure (12). The suntan holding structure (12) can be maneuvered to reach hard to reach areas of the body of the person (22) to apply the suntan lotion (14) thereto.

13 Claims, 2 Drawing Sheets

SUNTAN LOTION APPLICATOR

BACKGROUND OF THE INVENTION

1. Field of the Invention

The instant invention relates generally to substance applying devices and more specifically it relates to a suntan lotion applicator.

2. Description of the/Prior Art

Numerous substance applying devices have been provided in prior art that are adapted to place in contact, by putting or spreading liquids on surfaces, such as medicines, polishes, paints or the like. While these units may be suitable for the particular purpose to which they address, they would not be as suitable for the purposes of the present invention as heretofore described.

SUMMARY OF THE INVENTION

A primary object of the present invention is to provide a suntan lotion applicator that will overcome the shortcomings of the prior art devices.

Another object is to provide a suntan lotion applicator that is a very inexpensive, disposable, simple tool which can reach all the hard to reach places on the body of a person, for applying suntan lotion thereto.

An additional object is to provide a suntan lotion applicator that can be offered as a free sales promotional item, which will be wrapped and given away with a purchase of a suntan lotion bottle by a suntan lotion company.

A further object is to provide a suntan lotion applicator that is simple and easy to use.

A still further object is to provide a suntan lotion applicator that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
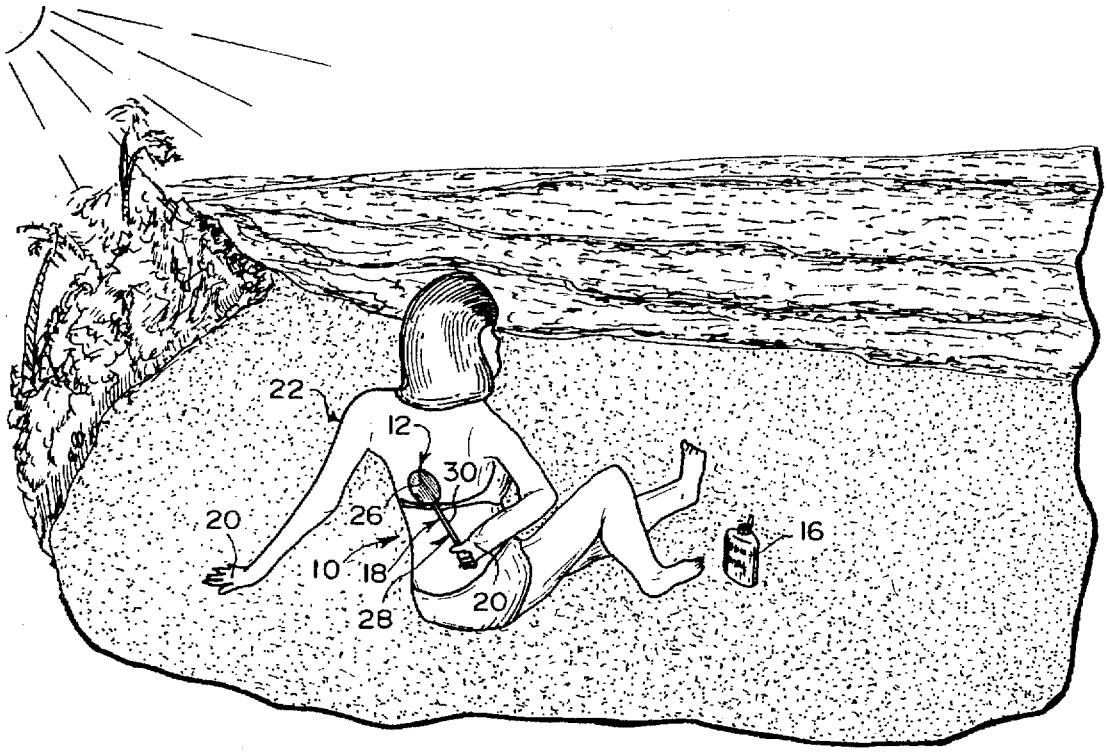
FIG. 1 is a rear perspective view showing a person using a first embodiment of the instant invention.

Turning now descriptively to the drawings, in which similar reference characters denote similar elements throughout the several views, FIGS. 1 through 9 illustrate a suntan lotion applicator 10 which comprises a structure 12 for holding a specific amount of suntan lotion 14 poured out from a suntan lotion bottle 16. A component 18 is for grasping by the hands 20 of a person 22, extends from the suntan lotion holding structure 12. The suntan lotion holding structure 12 can be maneuvered to reach hard to reach areas of the body of the person 22 to apply the suntan lotion 14 thereto.

The suntan lotion holding structure 12 includes a sponge pad 24, to receive the suntan lotion 14 poured out from the suntan lotion bottle 16. A base 26 is for supporting the sponge pad 24. The sponge pad 24 is circular shaped. The base 26 is also circular shaped.

The grasping component 18, as shown in FIGS. 1 through 8, is an elongated handle 28 extending from one side of the suntan lotion holding structure 12. The elongated handle 28 in FIGS. 1 through 4, is tubular shaped 30.

Figure 4:
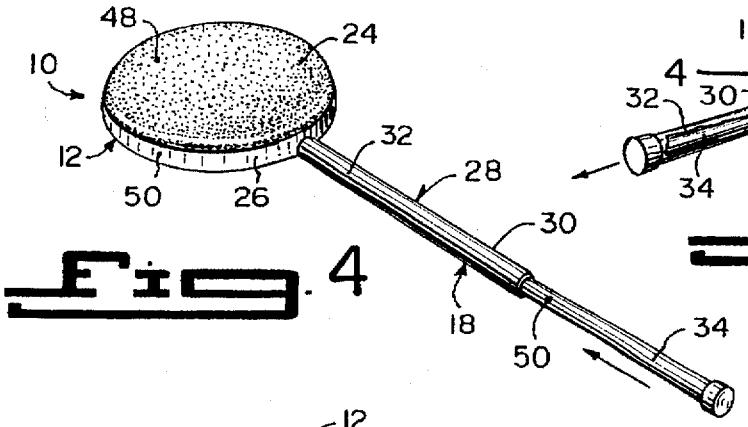
FIG. 4 is a perspective view taken in the direction of arrow 4 in FIG. 3, showing the telescopic handle in an extended position.
Figure 3:
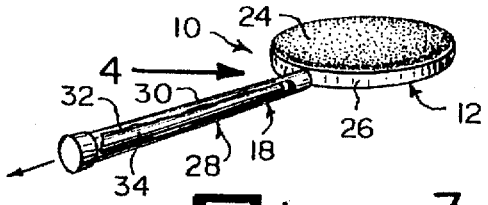
FIG. 3 is a perspective view of a second embodiment of the instant invention with part of the telescopic handle broken away and in a retracted position.

In FIGS. 3 and 4, the tubular shaped handle 30 is telescopic and includes a first hollow segment 32 attached to the side of the suntan lotion holding structure 12. A second segment 34 slides within the first hollow segment 32, so that the length of the tubular shaped handle 30 can be adjusted as needed.

Figure 6:
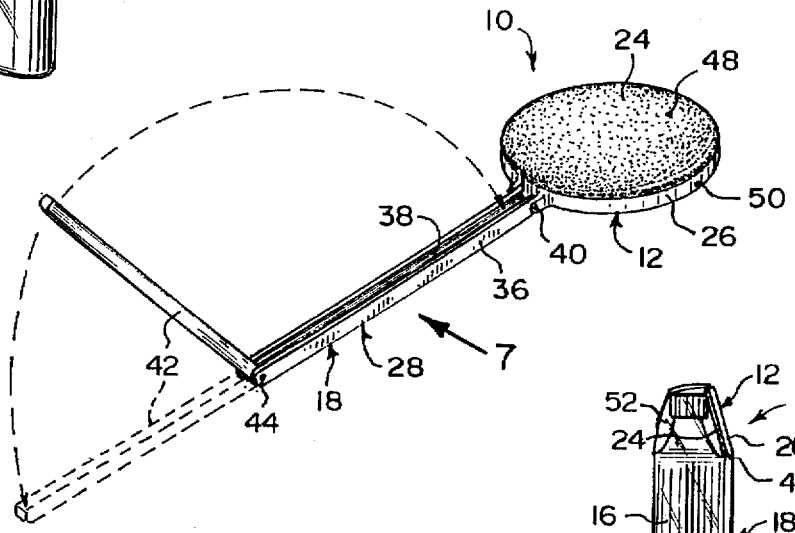
FIG. 6 is a perspective view of a third embodiment of the instant invention, showing the folding handle partly folded up.
Figure 8:
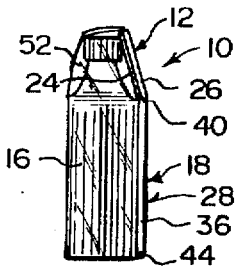
FIG. 8 is a side view showing the third embodiment packaged with a suntan lotion bottle.
Figure 7:
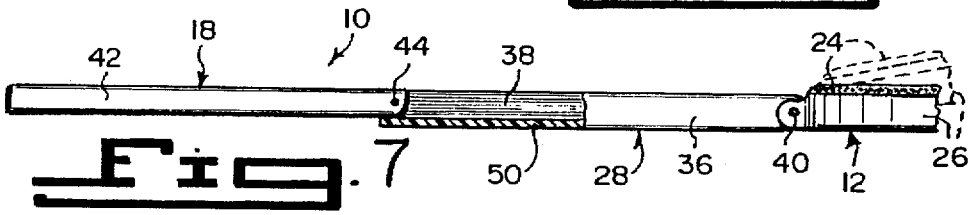
FIG. 7 is a side view taken in the direction of arrow 7 in FIG. 6, with parts broken away and in section.

In FIGS. 6, 7 and 8, the elongated handle 28 is foldable and consists of a first member 36 having a longitudinal slot 38 therealong. A first hinge 40 is for attaching a first end of the first member 36 to the side of the suntan lotion holding structure 12. A second member 42 is provided. A second hinge 44 is between a second end of the first member 36 and an abutting end of the second member 42. The second member 42 can swing up and fit into the longitudinal slot 38 in the first member 36 when not in use.

Figure 9:
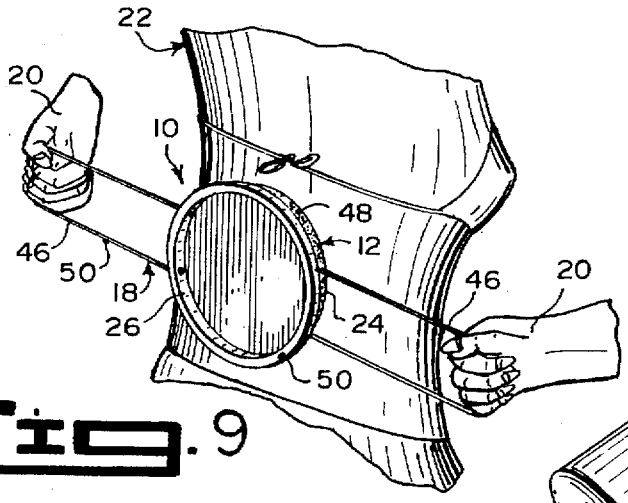
FIG. 9 is a rear perspective view with parts broken away, showing a person using a fourth embodiment of the instant invention.

The grasping component 18 in FIG. 9, includes a pair of pull cords 46 extending from opposite sides of the suntan lotion holding structure 12. The sponge pad 24 is made out of foam rubber material 48. The base 26 is made out of plastic material 50. The component 18 is also made out of plastic material 50.

Figure 5:
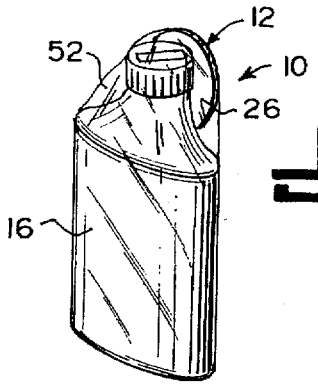
FIG. 5 is a perspective view showing the second embodiment packaged with a suntan lotion bottle.

In FIGS. 5 and 8, a shrink wrap is provided, so that the suntan lotion applicator 10 can be packaged together with the suntan lotion bottle 16, which can be offered as a free sales promotional item by a suntan lotion company. Other types of packaging such as blister cards, boxes and poly bags, not shown in the drawings, can also be utilized. Other types of lotions can also be used in conjunction with the applicator 10, to reach the hard to reach areas of the body of the person 22.

OPERATION OF THE INVENTION

Figure 2:
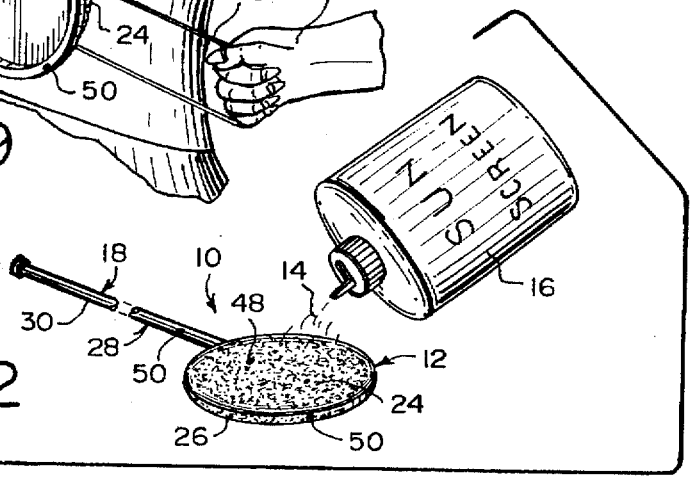
FIG. 2 is an enlarged perspective view of the first embodiment, showing suntan lotion being applied to the sponge pad from a suntan lotion bottle.

To use the suntan lotion applicator 10 in FIGS. 1 and 2, the following steps should be taken:

1. Pour some of the suntan lotion 14 from the suntan lotion bottle 16 onto the sponge pad 24.
2. Grasp the elongated handle 28 by a hand 20.
3. Rub the sponge pad 24 with the suntan lotion 14 onto a hard to reach area of the body of the person 22, such as the back.

To use the suntan lotion applicator 10 as shown in FIGS. 3 and 4, the following steps should be taken:

1. Pour some of the suntan lotion 14 from the suntan lotion bottle 16 onto the sponge pad 24.
2. Extend the second segment 34 of the telescopic tubular shape handle 30.
3. Grasp the tubular shape handle 30 by a hand 20.
4. Rub the sponge pad 24 with the suntan lotion 14 onto a hard to reach area of the body of the person 22, such as the back.

To use the suntan lotion applicator 10 as shown in FIGS. 6 and 7, the following steps should be taken:

1. Pour some of the suntan lotion 14 from the suntan lotion bottle 16 onto the sponge pad 24.
2. Remove the second member 42 from the longitudinal slot 38 in the first member 36 of the foldable elongated handle 28.
3. Extend the second member 42 in a straight line with the first member 36.
4. Grasp the foldable elongated handle 28 by a hand 20.
5. Rub the sponge pad 24 with the suntan lotion 14 onto a hard to reach area of the body of the person 22, such as the back.

To use the suntan lotion applicator 10 as shown in FIG. 9, the following steps should be taken:

1. Pour some of the suntan lotion 14 from the suntan lotion bottle 16 onto the sponge pad 24.
2. Grasp the pull cords 46 with both hands 20.
3. Rub the sponge pad 24 with the suntan lotion 14 onto a hard to reach area of the body of the person 22, such as the back.

LIST OF REFERENCE NUMBERS

10 suntan lotion applicator
12 suntan lotion holding structure of 10
14 suntan lotion in 16
16 suntan lotion bottle
18 grasping component of 10
20 hand of 22
22 person
24 sponge pad of 12
26 base of 12
28 elongated handle for 18
30 tubular shape for 28
32 first hollow segment of 30
34 second segment of 30
36 first member of 28
38 longitudinal slot in 36
40 first hinge of 28
42 second member of 28
44 second hinge of 28
46 pull cord
48 foam rubber material for 24
50 plastic material for 26 and 18
52 shrink wrap It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A suntan lotion applicator which comprises:

a) means for holding a specific amount of suntan lotion poured out from a suntan lotion bottle; and b) means for grasping by the hands of a person extending from said suntan lotion holding means, so that said suntan lotion holding means can be maneuvered to reach hard to reach areas of the body of the person to apply the suntan lotion thereto, said gasping means being a foldable elongated handle extending from one side of said suntan lotion holding means and including:

i) a first member having a longitudinal slot therealong:

ii) a first hinge for attaching a first end of said first member to the side of said suntan lotion holding means:

iii) a second member: and iv) a second hinge between a second end of said first member and an abutting end of said second member, so that said second member can swing up and fit into said longitudinal slot in said first member when not in use.

2. A suntan lotion applicator as recited in claim 1, wherein said suntan lotion holding means includes:

a) a sponge pad to receive the suntan lotion poured out from the suntan lotion bottle; and b) a base for supporting said sponge pad.

3. A suntan lotion applicator as recited in claim 2, wherein said sponge pad is circular shaped.

4. A suntan lotion applicator as recited in claim 2, wherein said base is circular shaped.

5. A suntan lotion applicator as recited in claim 2, wherein said sponge pad is made out of foam rubber material.

6. A suntan lotion applicator as recited in claim 2, wherein said base is made out of plastic material.

7. A suntan lotion applicator as recited in claim 1, wherein said grasping means is made out of plastic material.

8. A suntan lotion applicator as recited in claim 1, further in combination with a shrink wrap, so that said suntan lotion applicator can be packaged together with the suntan lotion bottle, which can be offered as a free sales promotional item by a suntan lotion company.

9. A suntan lotion applicator which comprises:

a) a circularly shaped sponge pad to receive suntan lotion poured out from a suntan lotion bottle;

b) a circularly shaped base for supporting said sponge pad; and c) means for grasping, by the hands of a person, extending from said base, so that said sponge pad on said base can be maneuvered to reach hard to reach areas of the body of the person to apply the suntan lotion thereto, said grasping means including a pair Of pull cords extending from opposite sides of said base.

10. A suntan lotion applicator as recited in claim 9, wherein said sponge pad is made out of foam rubber material.

11. A suntan lotion applicator as recited in claim 10, wherein said base is made out of plastic material.

12. A suntan lotion applicator as recited in claim 11, wherein said grasping means is made out of plastic material.

13. A suntan lotion applicator as recited in claim 12, further in combination with a shrink wrap, so that said suntan lotion applicator can be packaged together with the suntan lotion bottle, which can be offered as a free sales promotional item by a suntan lotion company.

* * * * *